US007281577B2

(12) United States Patent
Rioufol et al.

(10) Patent No.: US 7,281,577 B2
(45) Date of Patent: Oct. 16, 2007

(54) DOWNHOLE MEASUREMENT SYSTEM AND METHOD

(75) Inventors: Emmanuel Rioufol, Lons (FR); Brian W. Cho, Sugar Land, TX (US); Mark W. Brockman, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 119 days.

(21) Appl. No.: 10/711,396

(22) Filed: Sep. 16, 2004

(65) Prior Publication Data

US 2006/0016595 A1 Jan. 26, 2006

Related U.S. Application Data

(60) Provisional application No. 60/522,023, filed on Aug. 3, 2004, provisional application No. 60/521,934, filed on Jul. 22, 2004.

(51) Int. Cl.
*E21B 43/00* (2006.01)
*E21B 47/006* (2006.01)

(52) U.S. Cl. ..... 166/250.17; 73/152.54

(58) Field of Classification Search ..... 166/250.01, 166/250.07, 250.17; 73/152.54, 152.55, 73/152.51, 152.52
See application file for complete search history.

(56) References Cited

U.S. PATENT DOCUMENTS

| | | | | |
|---|---|---|---|---|
| 3,750,766 | A | 8/1973 | Thompson et al. | |
| 4,378,051 | A | 3/1983 | Cholet et al. | |
| 2003/0131990 | A1* | 7/2003 | Tubel et al. | 166/250.01 |
| 2004/0026092 | A1 | 2/2004 | Divis et al. | |
| 2004/0060696 | A1 | 4/2004 | Schultz et al. | |
| 2004/0065439 | A1 | 4/2004 | Tubel et al. | |

FOREIGN PATENT DOCUMENTS

| | | |
|---|---|---|
| EP | 0621397 | 8/1973 |
| GB | 1146824 | 3/1969 |
| GB | 2142679 | 1/1985 |
| GB | 2289760 | 11/1995 |
| GB | 2396216 | 6/2004 |
| WO | 00/75477 | 12/2000 |

* cited by examiner

*Primary Examiner*—William Neuder
*Assistant Examiner*—Nicole A Coy
(74) *Attorney, Agent, or Firm*—Bob Van Someren; Dona C. Edwards; Bryan P. Galloway

(57) ABSTRACT

One aspect of the present invention is a system and method to measure a pressure or other measurement at a source (e.g. a hydraulic power supply) and in or near a downhole tool and compare the measurements to verify that, for example, the supply is reaching the tool. Another aspect of the present invention is a system and method in which a gauge is positioned within a packer. Yet another aspect of the invention relates to a gauge that communicates with the setting chamber of a packer as well as related methods. Other aspects and features of the system and method are also described. It is emphasized that this abstract is provided to comply with the rules requiring an abstract, which will allow a searcher or other reader to quickly ascertain the subject matter of the technical disclosure. It is submitted with the understanding that it will not be used to interpret or limit the scope or meaning of the claims.

12 Claims, 4 Drawing Sheets

FIG. 3
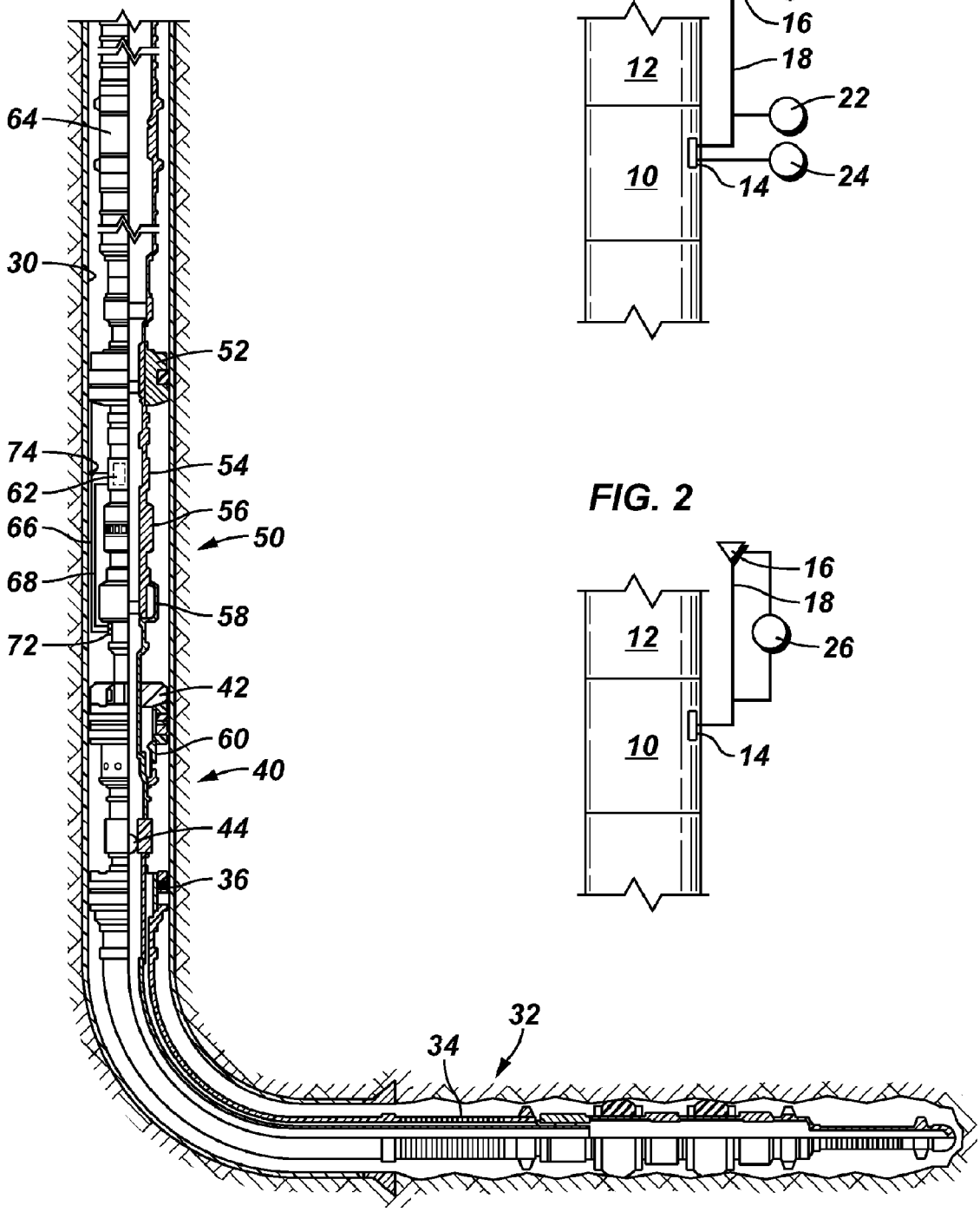
FIG. 1
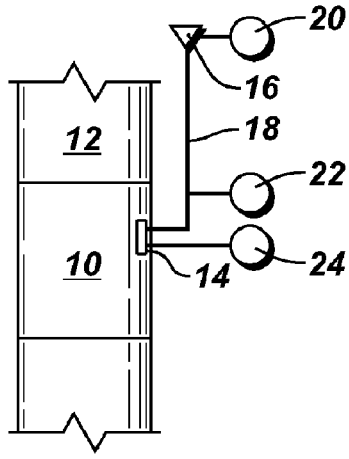
FIG. 2

DOWNHOLE MEASUREMENT SYSTEM AND METHOD

The following is based upon and claims priority to U.S. Provisional Application Ser. No. 60/521,934, filed Jul. 22, 2004 and U.S. Provisional Application Ser. No. 60/522,023, filed Aug. 3, 2004.

BACKGROUND OF THE INVENTION

Field of Invention

The present invention relates to the field of measurement. More specifically, the invention relates to a device and method for taking downhole measurements as well as related systems, methods, and devices.

SUMMARY

One aspect of the present invention is a system and method to measure a pressure or other measurement at a source (e.g. a hydraulic power supply) and in or near a downhole tool and compare the measurements to verify that, for example, the supply is reaching the tool. Another aspect of the present is a system and method in which a gauge is positioned within a packer. Yet another aspect of the invention relates to a gauge that communicates with the setting chamber of a packer as well as related methods. Other aspects and features of the system and method are further discussed in the detailed description.

BRIEF DESCRIPTION OF THE DRAWINGS

The manner in which these objectives and other desirable characteristics can be obtained is explained in the following description and attached drawings in which:

FIG. 1 illustrates an embodiment of the present invention including a downhole tool, a supply, and alternate pressure measurements.

FIG. 2 shows an alternative embodiment of the present invention.

FIG. 3 illustrates an embodiment of the present invention deployed in a well.

Figure 4:
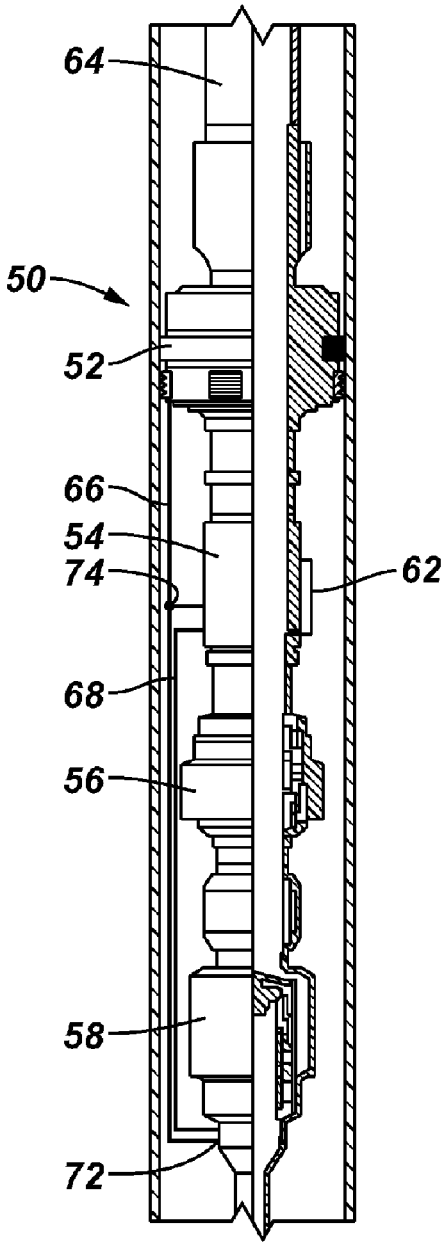
FIG. 4 illustrates a subsection of FIG. 3.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

The present invention relates to various apparatuses, systems and methods for measuring well functions. One aspect of the present invention relates to a measurement method comprising measuring a characteristic of a supply, measuring the characteristic in or near a downhole tool and spaced from the supply measurement, and comparing the measurements (e.g., using a surface or downhole controller, computer, or circuitry). Another aspect of the present invention relates to a measurement system, comprising a first sensor adapted to measure a characteristic of a supply, a second sensor adapted to measure the characteristic in or near a downhole tool, the second sensor measuring the characteristic at a point that is spaced from the supply measurement. Other aspects of the present invention, which are further explained below, relate to verifying downhole functions using the measurements, improving feedback, providing instrumentation to downhole equipment without incorporating the gauges within the equipment itself and other methods, systems, and apparatuses. Further aspects of the present invention relate to placement of gauges in or near packers as well as related systems and methods.

As an example, FIG. 1 illustrates a well tool 10 attached to a conduit 12. The tool has a hydraulic chamber 14, such as a setting chamber, therein. The hydraulic chamber 14 may be, for example, an area within the tool 10 into which hydraulic fluid is supplied to actuate the tool 10. A remote source 16 supplies hydraulic fluid to the well tool 10 (i.e., the hydraulic chamber 14) via a hydraulic control line 18. The source 16 may be located at the surface or downhole. A first sensor 20 measures a characteristic at the source 16. For example, the sensor 20 may measure the pressure of the hydraulic fluid at the source 16 that is supplied to the control line 18. A second sensor 22 measures the characteristic in the control line 18 at a position near the tool 10 and spaced from the first sensor measurement. If applied to the example mentioned above, the second sensor may measure the pressure in the control line 18 proximal the well tool 10. FIG. 1 also shows an alternative design in which the alternative second sensor 24 measures the characteristic in the tool 10 (e.g., in the hydraulic chamber 14). The alternative second sensor 24 may be external to the tool 10 in which case the sensor 24 is hydraulically and functionally plumbed to measure the pressure in the tool 10. Alternatively, the sensor 10 is positioned within the tool 10. The sensors 22 and 24 are described as alternatives and only one may be used, although alternative arrangements may use both sensors 22 and 24.

In use, the measurements from the first sensor 20 and the second sensor 22 and/or alternative second sensor 24 are compared. The comparison may reveal whether the supplied fluid is actually reaching the tool. For example, if the control line 18 is blocked the measurements between the first sensor 20 and the second sensor 22 (or alternative second sensor 24) will be different. If these values are substantially the same, the operator can determine that the source is actually reaching the tool.

FIG. 2 illustrates another aspect of the present invention in which the two sensors 20 and 22 of FIG. 1 are replaced with a differential sensor 26 (e.g., a differential pressure gauge). The measurement of the differential sensor 26 can likewise indicate potential problems in and provide confirmation of whether the supply is reaching the tool 10. The differential sensor 26 is shown measuring the characteristic in the control line 18 near the tool 10. However, as in the embodiment of FIG. 1, the sensor could alternatively measure the characteristic within the tool 10.

FIG. 3 illustrates one potential application of the present invention and a system and method of the present invention applied in a multizone well 30. A lower completion 32 for producing a lower zone of the well 30 has a sand screen 34, packer 36, and other conventional completion equipment. An isolation system 40 above the lower completion 32 comprises a packer 42 and an isolation valve 44. The isolation valve 44 selectively isolates the lower completion 32 when closed. An upper completion 50 (see also FIGS. 4 and 5) for producing an upper zone of the well 30 comprises, from top to bottom, a hydraulically set packer 52 (e.g., a production packer or gravel pack packer), a gauge mandrel 54, an annular control valve 56, an in-line control valve 58 and a lower seal assembly 60. The lower seal assembly 60 stabs into the isolation assembly 40 to hydraulically couple the upper completion 50 to the isolation assembly 40. Thereby, the in-line control valve 58 is in fluid communication with the lower completion 32 and may be used to control production from the lower completion 32. The annular control valve 56 of the upper completion 50 may be used to control production from the upper formation. The gauge mandrel 54 houses numerous pressure gauges 62.

After the upper completion 50 is placed in the well 30 the annular valve 56 and the in-line valve 58 are both closed and pressure is applied inside the production tubing 64 to test the tubing 64. The packer 52 is then set.

In order to set the packer 52 of the upper completion 50, the annular valve 56 is closed and the in-line valve 58 is opened. The isolation valve 44 is closed and the pressure in the tubing 64 is increased to a pressure sufficient to set the packer 52. A packer setting line 66 extends from the packer 52 and communicates with the tubing 64 at a position below the in-line valve 58. In this example, the pressure in the tubing 64 acts as the source of pressurized hydraulic fluid used to set the packer. This porting of the packer 52 is necessary to prevent setting of the packer 52 during the previously mentioned pressure test of the tubing 64.

One of the pressure gauges 62*a* communicates with the interior of the tubing 64, the source of the pressurized setting fluid, via a gauge 'snorkel' line 68. The snorkel line 68 communicates with the tubing 64 at a position below the in-line valve 58 and, thereby, measures the pressure of the source of pressurized hydraulic fluid used to set the packer. This pressure gauge 62*a* provides important continuing data about the produced fluid and well operation.

It is often desirable to have a second redundant pressure gauge 62*b* or sensor that measures the same well characteristic to, for example, verify the measurement of the first gauge, provide the ability to average the measurements, and allow for continued measurement in the event of the failure of one of the gauges. Typically, the primary gauge 62*a* and the back-up gauge 62*b* are ported via independent snorkel lines 68 to the substantially same portions of the well. However, in the present invention, the 'redundant' pressure gauge 62*b* is plumbed to and fluidically communicates with the packer setting line 66 via connecting line 70. Therefore, the redundant pressure gauge 62*b* measures the pressure in the packer setting line 66 near the packer 52 at a location that is spaced from the location of the measurement of the first pressure gauge 62*a*. Both pressure gauges 62*a* and 62*b* remain in fluid communication with the production tubing 64 at a point below the in-line valve 58 and provide the important continuing data about the produced fluid and well operation at this portion of the well. However, by fluidically connecting the back-up gauge 62*b*, the operator can determine whether a blockage has occurred in packer setting line 66 between the inlet 72 and the connection point 74 to the connecting line 70. Positioning the connection point 74 near the packer 52 helps to verify that the pressurized fluid is actually reaching the packer 52. In addition, using the connection line 70 attached to the packer setting line 66 can reduce the amount of hydraulic line used in the completion. Additionally, due to system used in the present invention, the pressure gauge 62*b* provides a dual function of measuring the pressure in the well and helping to verify that the packer 52 is set. The added feature is provided at a minimal incremental cost. In some cases, for example when operating in a high debris environment, the packer setting line 66 may become plugged. If the operator quantifiably knows that pressure either has or has not reached the packer setting chamber, successful mitigation measures may be more easily deployed.

Note that as mentioned above in connection with FIG. 1, the connection point 74 may be moved to within the packer setting chambers to validate the actual pressure delivered to the packer 52. Additionally, as discussed above in connection with FIG. 2, the two pressure gauges may be replaced with a differential pressure gauge to provide the verification.

Figure 5:
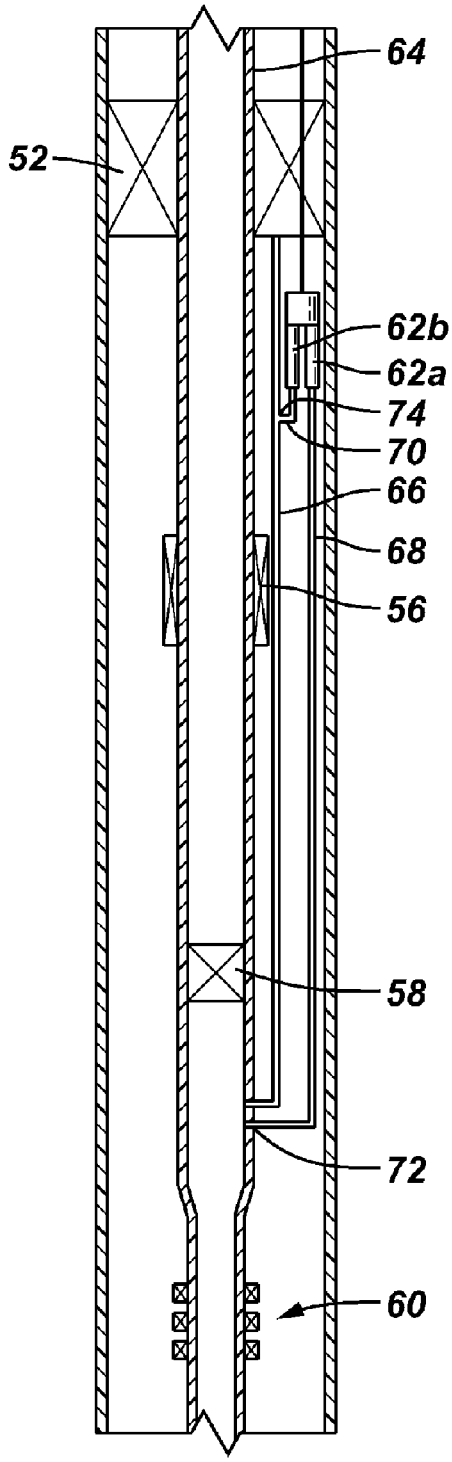
FIG. 5 is a schematic of the present invention and the embodiment of FIG. 3.
Figure 6:
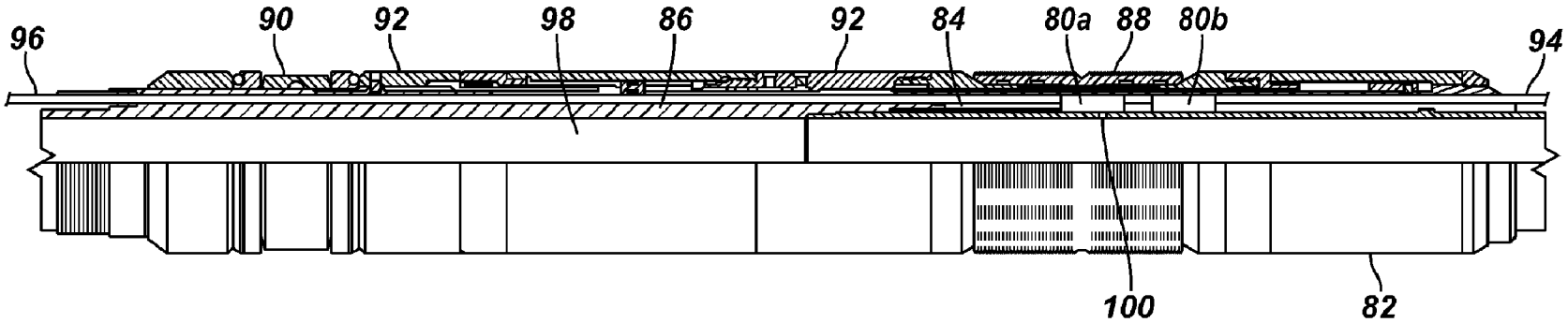
FIG. 6 illustrates another embodiment of the present invention in which a gauge is incorporated into a packer.

FIG. 6 illustrates an embodiment of the present invention in which a gauge 80 is positioned within a packer 82 potentially eliminating the need for a separate gauge mandrel. Note that the previous description and FIGS. 3-5 show a separate gauge mandrel 54, located below the packer 52, which houses the gauges 62. The present embodiment may reduce the overall completion cost for some completions by eliminating the gauge mandrel 54. The gauge 80 is mounted within the setting chamber 84 of the packer 82 in the embodiment shown in the figure, although the gauge 80, may also be mounted within other portions of the packer 82.

In FIG. 6, the packer 82 has a mandrel 86 on which are slips 88, elements 90, and setting pistons 92. Pressurized fluid applied to the setting chamber 84 hydraulically actuates the pistons 92 setting the packer 82. In alternate designs, the pressurized fluid may be applied to the packer 82 by either a hydraulic control line 94, which extends below the packer 82 as discussed previously or which extend to the surface (not shown), or via ports in the packer 82 that communicate with the tubing (the discussion of FIG. 7 will describe such a packer).

Typically, the space available in a packer 82 outside the mandrel 86 (e.g., in the setting chamber 84) is insufficient to house a gauge 80 such as a pressure gauge. However, with the advent of MEMS ("Micro-Electro-Mechanical Systems") and nanotechnology it is possible and will increasingly become possible to make very small gauges. These gauges 82 may be placed within existing packers or the packers may be only slightly modified to accommodate the small gauges. In addition, other customized gauges may be employed.

The embodiment illustrated in FIG. 6 shows a packer that has two gauges 80 in the setting chamber 84. Control line provides power and telemetry for the gauges 80. One of the gauges 80*a* communicates with the central passageway 98 of the mandrel 86 via port 100 and, thereby, measures the tubing pressure. The second gauge 80*b* communicates with an exterior of the packer 82 and, thereby, measures the annulus pressure. Additional gauges 80 may be supplied and the gauges may be positioned and designed to measure the pressure at different places within the well. For example, control lines may run from the packer to various points in the well to supply the needed communication. Also, gauges and sensors other than pressure gauges may be used to measure other well parameters, such as temperature, flow, and the like. The gauge 80 could additionally be designed to measure the pressure within the setting chamber 84. As discussed previously, measuring the pressure in the setting chamber 84 provides a confirmation that the pressure in the setting chamber 84 reached the required setting pressure for setting the packer 82. In addition, the pressure gauge 80 positioned in the setting chamber 84 and adapted to measure the pressure in the setting chamber 84 may also measure and provide continuing data about the pressure via the pressure setting ports or control lines (e.g., snorkel lines). Thus, a pressure gauge 80 so mounted provides the dual purpose of confirming packer setting and providing continuing pressure data.

By placing the gauges 80 in the packer 82, the gauges 80 are very well protected while eliminating the need for a separate mandrel. Eliminating the mandrel 54 also may eliminate the need for timed threads or other special alignment between the packer 80 and a mandrel 54. In addition, the total length of the completion may be reduced, the cost of equipment and the cost of completion assembly may be reduced, and the electrical connections and gauges 80 can be tested at the "shop" rather than at the well site, or downhole. The present invention provides other advantages as well.

Figure 7:
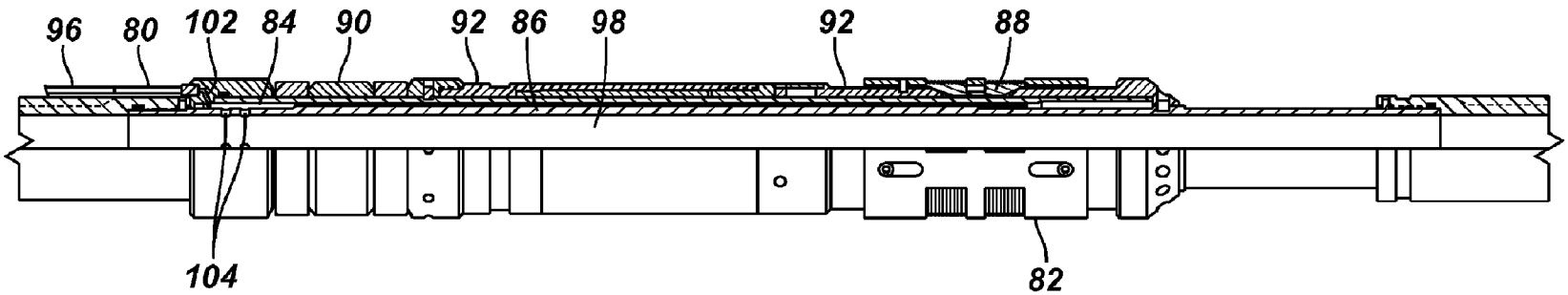
FIGS. 7 and 8 illustrate yet another embodiment of the present invention in which a gauge is provided above a packer and communicates with an interior of the packer.
Figure 8:
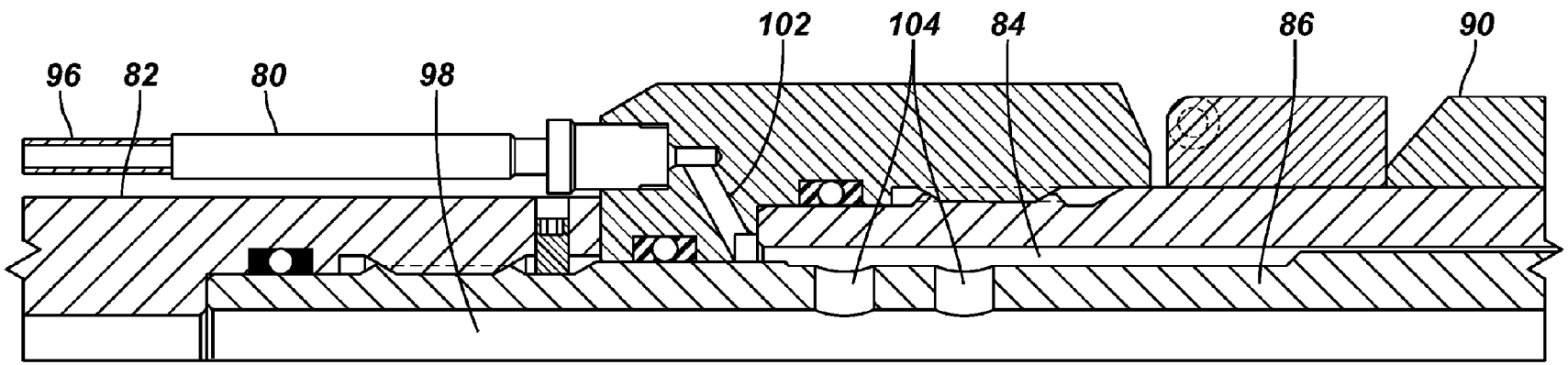

FIGS. 7 and 8 illustrate yet another embodiment of the present invention in which a gauge 80 is provided above a packer 82 and communicates with an interior of the packer 80. The embodiment of FIGS. 7 and 8 show a pressure gauge 80 that communicates with the interior setting chamber 84 of the packer 82 via a passageway 102, which in turn communicates with the interior central passageway 98 of the packer 82 via radial setting ports 104. In this way, the pressure gauge 82 can measure the pressure in the setting chamber 84 to confirm the setting pressure as well as the pressure in the central passageway 98 to measure the tubing pressure and provide continuing pressure information about the production and the well.

The present invention may be used with any type of packer. FIG. 7 shows the present invention implemented in one type of hydraulic packer 82. For a detailed description of a similar packer, please refer to U.S. Patent Application Publication No. U.S. 2004/0026092 A1. In general, the packer 82 shown has a mandrel 86 on which are slips 88, elements 90, and setting pistons 92. Setting ports 104 extend radially through the mandrel 86 providing fluid communication between an interior central passageway 98 of the mandrel 86 to a packer setting chamber 84 in the packer 82. The setting ports 104 communicate the tubing pressure through the mandrel 86 into the setting chamber 84 of the packer 82.

The packer 82 shown is hydraulically actuated by fluid pressure that is applied through a central passageway 98 of the mandrel 86. The pressure of the fluid in the central passageway 98 is increased to actuate the pistons 92 to set the packer 82.

The figures show the gauge 80 connected to the top of the packer 82. This type of connection eliminates the need for an additional gauge mandrel 54. In alternative designs, the gauge 80 may be placed further above the packer 82 with a conduit (e.g., snorkel line) connecting the gauge 80 to the packer 82.

As mentioned above, because the gauge 80 measures the pressure of the setting chamber 84, it is possible to follow the setting sequences of the packer 82. The sensor also provides the dual function of also measuring the tubing pressure in the packer 82 shown. Note that if the packer 82 is set by annulus pressure or control line pressure, a gauge communicating with the setting chamber 84 measures the pressure from that pressure source 16. In addition, the invention of FIGS. 7 and 8, as well as that of FIG. 6, may be implemented in other types of packers, such as mechanically set packers. The packer 82 may be ported in a variety of ways and additional passageways or ports may be provided to allow measurement at other points in the well (e.g., ports to the annulus, snorkel lines to other locations or equipment in the well, passageways in a mechanically-set packer, etc).

Furthermore, the inventions of FIGS. 6-8 may be used in the confirmation system previously discussed. Specifically, in both of the inventions of FIGS. 6 and 7-8, a pressure gauge 80 may be used to measure the pressure in the setting chamber 84. The pressure data from the gauge 80 may be compared to a measurement at the supply to confirm that the source 16 is reaching the setting chamber. In addition, additional gauges 80 in the packer 82 (e.g., in the embodiment of FIG. 6) may be ported to communicate with the source 16 to provide the desired measurements while potentially eliminating the need for a gauge mandrel 54. These dual gauges 80 may also provide the desired redundancy discussed above depending upon the porting of the gauges.

Note that in the above embodiments, the gauge is ported or positioned to measure the actual or direct characteristic as opposed to an indirect characteristic. For example, the gauge 80 in FIG. 7 is directly ported to the setting chamber 84 of the packer 82 and thus provides a direct measurement. This is opposed to an indirect measurement in which a tubing pressure measurement remotely located or not interior to the packer 82 is made to show setting chamber pressure.

The above discussion has focused primarily on the use of pressure gauges in packers, although some other measurements are mentioned. It should be noted, however, that the present invention may be incorporate other types of gauges and sensors (e.g., in the packer of as shown in FIG. 6 or to compare measurements from two sensors, etc.). For example, the present invention may use temperature sensors, flow rate measurement devices, oil/water/gas ratio measurement devices, scale detectors, equipment sensors (e.g., vibration sensors), sand detection sensors, water detection sensors, viscosity sensors, density sensors, bubble point sensors, pH meters, multiphase flow meters, acoustic detectors, solid detectors, composition sensors, resistivity array devices and sensors, acoustic devices and sensors, other telemetry devices, near infrared sensors, gamma ray detectors, H2S detectors, CO2 detectors, downhole memory units, downhole controllers, locators, strain gauges, pressure transducers, and the like.

Although only a few exemplary embodiments of this invention have been described in detail above, those skilled in the art will readily appreciate that many modifications are possible in the exemplary embodiments without materially departing from the novel teachings and advantages of this invention. For example, much of the description contained here deals with pressure measurement and pressure sensors, in other applications of the present invention the sensors may be designed to measure temperature, flow, sand detection, water detection, or other properties or characteristics. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for use in a well, comprising:

a sensor system of one or more sensors to measure a characteristic of a fluid supply and to measure the characteristic in or near a downhole tool at a position that is spaced from the supply measurement, the one or more sensors being connected to a one or more of sensing locations such that at least one connection between a sensor and a sensing location is, by a dedicated snorkel line a lower completion in the well;

an upper completion above the lower completion;

an isolation system between and in fluid communication with the lower completion and the upper completion, the isolation system is adapted to selectively fluidically isolate the lower completion from the upper completion;

the upper completion comprising;

a packer comprising the downhole tool, the packer having a setting chamber therein:

a gauge mandrel below the packer that has one or more sensors therein;

an annular control valve below the gauge mandrel;

an in-line control valve below the annular control valve;

a packer setting line in fluid communication with the setting chamber of the packer and an interior passageway of the upper completion at a position below the in-line control valve;

a pressure sensor in the gauge mandrel in fluid communication with the packer setting line adapted to measure a pressure in the control line.

2. The system of claim 1, wherein the system of one or more sensors comprises a differential sensor.

3. The system of claim 1, further comprising:

a first sensor adapted to measure the characteristic of a supply;

a second sensor adapted to measure the characteristic in or near the downhole tool, the second sensor measuring the characteristic at the position that is spaced from the supply measurement.

4. The system of claim 3, wherein the second sensor is positioned external to the downhole tool.

5. The system of claim 3, wherein the second sensor is positioned within the downhole tool.

6. The system of claim 3, further comprising:

a control line in fluid communication with the downhole tool and the supply;

the second sensor is adapted to measure the characteristic in the control line.

7. The system of claim 3, wherein the second sensor is further adapted to measure the characteristic of the supply.

8. The system of claim 1, wherein the supply is a downhole supply.

9. The system of claim 1, wherein the characteristic is pressure.

10. The system of claim 1, wherein the one or more sensors are pressure gauges.

11. The system of claim 1, wherein the sensor system comprises a sensor adapted to measure the characteristic in the setting chamber.

12. The system of claim 1, further comprising a pressure sensor in the gauge mandrel in fluid communication with the interior passageway of the upper completion at a position below the in-line control valve.

* * * * *